United States Patent [19]

Givler

[11] 4,319,214

[45] Mar. 9, 1982

[54] CREEPLESS, SNAP ACTION THERMOSTAT

[75] Inventor: Omar Givler, North Canton, Ohio

[73] Assignee: Portage Electric Products, Inc., North Canton, Ohio

[21] Appl. No.: 169,469

[22] Filed: Jul. 16, 1980

[51] Int. Cl.[3] ..... H01H 37/74

[52] U.S. Cl. ..... 337/343; 337/365

[58] Field of Search ..... 337/53, 89, 343, 346, 337/349, 365

[56] References Cited

U.S. PATENT DOCUMENTS

| | | | |
|---|---|---|---|
| 2,716,175 | 8/1955 | Franklin | 337/349 X |
| 3,430,177 | 2/1969 | Audette | 337/365 |
| 3,443,259 | 5/1969 | Wehl et al. | 337/89 |
| 4,149,138 | 4/1979 | Pevzner et al. | 337/343 X |
| 4,157,525 | 6/1979 | Grable | 337/365 |

*Primary Examiner*—George Harris

*Attorney, Agent, or Firm*—McAulay, Fields, Fisher, Goldstein & Nissen

[57] ABSTRACT

A creepless, snap action thermostat is formed employing two movable contacts. One of the contacts is mounted to a bimetallic arm which moves as the temperature of the environment in which the thermostat is located increases. The second movable contact is mounted on a spring arm, the spring arm following the motion of the bimetallic arm upon increased heating, so as to maintain firm mating of the two contacts until the snap over point of the bimetal is reached. After snap over, the contact on the spring arm is prevented from following the contact on the bimetallic arm because of a physical stop formed in the thermostat casing.

7 Claims, 6 Drawing Figures

CREEPLESS, SNAP ACTION THERMOSTAT

FIELD OF THE INVENTION

Thermostatic switches are well known in the art and are employed to prevent overheat or overcurrent conditions in a great number of electrical appliances, both large and small. Generally, it is preferred that the opening of the thermostatic switch be accomplished on an essentially instantaneous basis at the predetermined temperature.

This essentially instantaneous breaking of the circuit has, however, been difficult to accomplish in practice because of the tendency of the contact formed on a bimetallic arm to move slightly away from the other contact while approaching the set point, or, particularly, at a temperature near the set point. Various means have been proposed to eliminate or reduce the effect of this creep so as to cause the thermostatic switch to open, essentially instantaneously, at the set point, without separation of the contacts prior to that set point.

Some of these have been generally successful as, for example, in U.S. Pat. No. 3,851,288, Stoll, assigned to the same assignee as the present invention. The Stoll patent discloses the use of two bimetallic arms, a movable contact associated with the end of each, and the two bimetallic arms deflecting at different rates as the ambient temperature is increased. While this is effective to prevent separation of the contacts until the desired point, such thermostats require calibration after assembly or field calibration to provide the proper setpoint.

Thus, a creepless, snap action thermostat which does not require calibration after assembly, and particularly one which is relatively inexpensive and lends itself to assembly by automation, has been sought.

SUMMARY OF THE INVENTION

In accordance with the present invention, it has unexpectedly been discovered that if one of the movable contacts in a thermostatic switch is attached to a cantilever mounted spring arm, and a mechanical stop is provided for the free end of the cantilever arm, a reliable, versatile, creepless snap action thermostat can be formed. The resulting thermostat is economical to manufacture and, at least in some embodiments, is particularly adapted to automatic manufacturing techniques.

More specifically, in addition to the movable contact attached at the free end of a cantilever mounted spring arm, a second movable contact is provided at the end of a bimetallic arm. The bimetallic arm may be either a simple or a composite arm, i.e., it may comprise a single, cantilever mounted bimetallic arm, or may involve two bimetallic arms which are connected, both mechanically and electrically. In either event, the bimetallic arms are provided with a pivot about which to rotate in breaking of the circuit, and with a dished portion to aid in the snap action.

The thermostat case employed according to the present invention is formed of two conductive halves separated by an insulator. Electrical connection is made to the contacts directly through the case. This type of construction allows the thermostat to be made with both of the terminals of the same side of the case, or with one terminal at each side, depending upon the specific use to which the thermostat is to be put.

DESCRIPTION OF THE PREFERRED EMBODIMENTS

Figure 1:
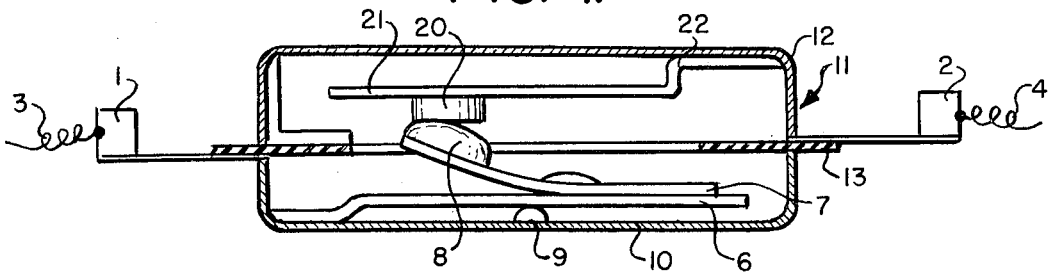
FIG. 1 is a view, in section, of a first embodiment according to the present invention, with the contacts in mating engagement.
Figure 2:
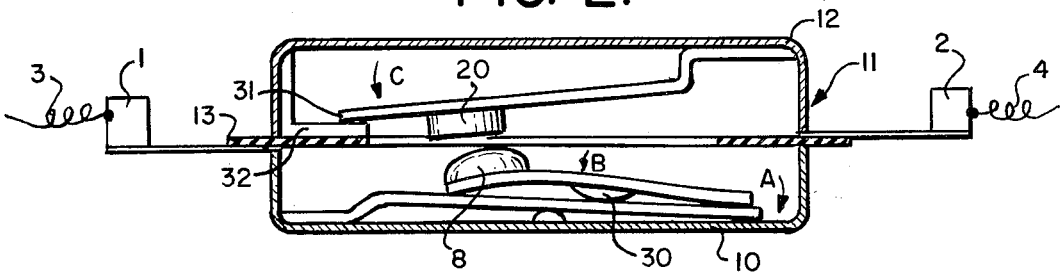
FIG. 2 is a view, similar to FIG. 1, with the contacts broken.

FIGS. 1 and 2 are views of a first embodiment of the present invention, FIG. 1 showing the contacts closed, and FIG. 2 showing the contacts open. The designations of the parts are the same for FIGS. 1 and 2.

First terminals 1 and 2 are shown for connection with external circuit leads 3 and 4. Terminal 1 is electrically connected via lower case half 10 to bimetallic element 6. Element 6 acts as a heater and compensator for operation of the overall device. Bimetallic element 6 is mechanically and electrically connected to bimetallic element 7. Bimetallic element 7 carries a movable contact 8. Bimetallic element 6 acts about a pivot 9 which is attached to the lower portion 10 of case 11. The upper portion of case 11 is illustrated at 12. Together, portions 10 and 12 constitute the overall case 11, within which are located all of the operative parts according to the present invention, the two halves of the case being separated by insulator 13.

Movable contact 8 is in mating engagement with movable contact 20. Movable contact 20 is attached to spring arm 21 which is cantilever mounted at 22 to the upper portion 12 of case 11. Spring arm 21 is electrically connected to terminal 2, via upper case half 12 so as to complete the circuit.

In operation, as the ambient temperature about the case 11 of FIG. 1 increases, the bimetallic element 6, which acts as both a heater and temperature compensator, begins to bend in the direction indicated by arrow A of FIG. 2, about pivot 9. Additionally, as the ambient temperature increases, bimetallic element 7 begins to deflect in the direction indicated by arrow B in FIG. 2. Because spring arm 21 is biased downwardly, in the direction indicated by arrow C in FIG. 2, as bimetallic arms 6 and 7 begin to bend in accordance with increased temperatures, spring arm 21 moves downwardly, thus maintaining a mating engagement between contacts 8 and 20. At the preset temperature, bimetallic arm 7 snaps about dimpled portion 30, and arm 21, with attached contact 20, is prevented from following it completely, as end 31 of arm 21 abuts against insulated stop member 32. This results in a breaking of the contact, and a cessation of electrical flow from terminal 1 to terminal 2.

Figure 3:
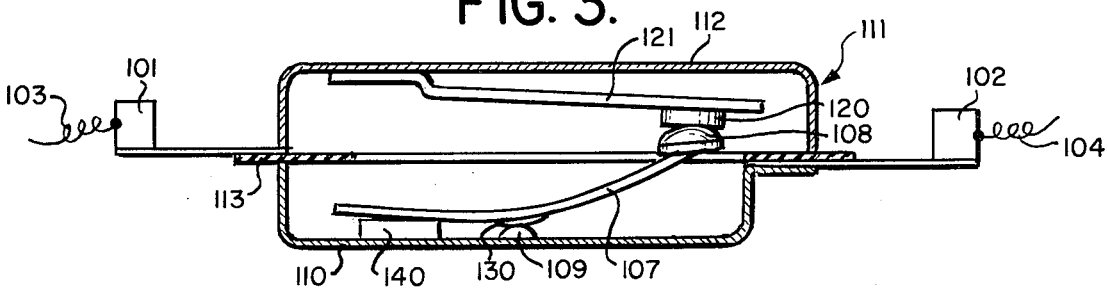
FIG. 3 is a sectional view according to a second embodiment of the present invention, with the contacts in engagement.
Figure 4:
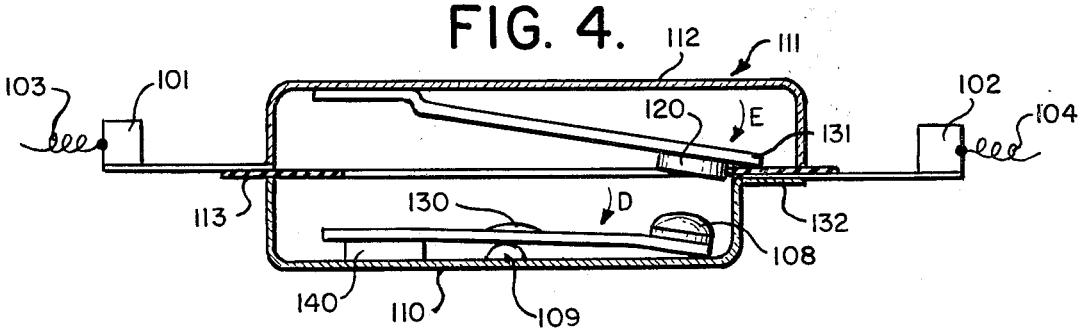
FIG. 4 is a view similar to FIG. 3, with the contacts broken.

A second embodiment of the invention is shown in FIGS. 3 and 4. Here, the parts are designated employing the same designation as in FIGS. 1 and 2 but with a prefix of "100." In this second embodiment, movable contacts 108 and 120 are provided. Contact 120 is mounted to cantilever mounted spring arm 121. Contact 108 is mounted to bimetallic arm 107 which pivots about a pivot 109. Adjacent this pivot is a dimpled portion 130, which provides for snap action of the bimetallic arm 107 when a predesignated temperature is reached. The bimetallic arm 107 is cantilever mounted at point 140. Again, terminal 101 is connected to electrical lead 103 and terminal 102 is connected to electrical lead 104. Terminal 101 is electrically connected via upper case half 112 to spring arm 121. Similarly, terminal 102 is electrically connected via lower case half 110 to cantilever mount 140. Upper case half 112 and lower case half 110 are electrically separated by insulator 113.

As the bimetallic arm 107 moves in the direction D, as indicated in FIG. 4, about pivot 109, contact 120 is maintained in mating engagement with contact 108 because of the spring action of arm 121. When the set point temperature is reached, bimetallic arm 107 snaps about the dimpled portion 130, at pivot 109, to move contact 108 sharply downward. Spring arm 121 continues to move in the direction indicated by arrow E, until its end 131 engages insulated stop 132, which prevents its further movement. Since end 131 is prevented from moving as far as contact 108, mating engagement is broken between contact 108 and contact 120, thus breaking the circuit between terminals 101 and 102.

Figure 5:
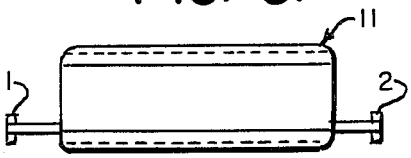
FIG. 5 is a view of a case according to the present invention with the two leads on opposite ends of the case.
Figure 6:
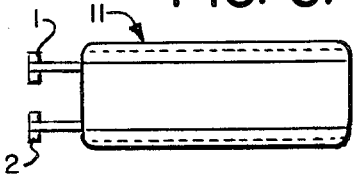
FIG. 6 is a view similar to FIG. 5 with the contacts on the same end of the case.

Connections are shown, respectively, between terminal 1 and bimetallic arm 6; between terminal 2 and spring arm 21; between terminal 102 and bimetallic arm 107; and between terminal 101 and spring arm 121. It is apparent that the contacts can be made with the terminals at opposite ends of cases 11 or 111, as illustrated in FIGS. 1 through 4, and as shown in FIG. 5, or the contacts can be made in such a way that both terminals, 1 and 2 or 101 and 102 are on the same end of case 11 or case 111, as illustrated in FIG. 6. This is one of the great advantages of the present invention, the fact that the side of the case on which the terminal is placed is not critical to operation of the device. Bimetallic blades, particularly when they are formed with the dimple to provide for snap action, have a definite snap point. However, because of the tendency to move, whether slight or not, as the temperature increases, there is a creep. This creep must be compensated for by calibration after assembly of the device. Because of the spring arm employed according to the present invention, the creep is eliminated, and thus the necessity for calibrating the device after assembly is eliminated.

With regard to the device of FIGS. 1 and 2, where bimetal 6 acts as a heater and compensator, this device is particularly useful when the thermostat is used in devices having a high current flow, such as 40 to 60 amps. In such a device, the bimetal 6 acts as a heat sink, increasing the opening time, and thus reducing the cycling of movable contact 8. Additionally, this model is more susceptible of formation in automatic equipment.

Further, the device of FIGS. 1 and 2 allows for utilization of different types of bimetal in the composite of bimetals 6 and 7. This allows for a much greater variations in the set point temperature, and time of opening, of the contacts in the device of FIGS. 1 and 2, as compared with prior creepless, snap action thermostats.

While the description has been given with regard to particular embodiments of the present invention, it should not be considered as limited to the specific examples shown and described, but only as limited by the appended claims.

I claim:

1. A creepless, snap action thermostat comprising:

a. a first movable contact attached to a snap action bimetallic arm;

b. a second movable contact attached to a cantilever mounted spring arm biased toward said bimetallic arm, wherein said first movable contact and said second movable contact are maintained in mating relationship during current flow through said thermostat;

c. a mechanical stop, said stop preventing continued mating relationship between said second movable contact and said first movable contact following snap action of said bimetallic arm; and d. wherein the bimetal arm is attached to a first, electrically conductive half of a case for said thermostat, the spring arm is attached to a second, electrically conductive half of the case, and the two halves of the case are separated by an insulator.

2. The creepless, snap action thermostat of claim 1 wherein a stationary pivot is provided for said bimetal arm.

3. The creepless, snap action thermostat of claim 1 wherein said bimetal arm is provided with a dimple to provide for snap action.

4. The creepless, snap action thermostat of claim 3 wherein the dimpled portion is adjacent a fixed pivot for the bimetal arm.

5. The creepless, snap action thermostat of claim 1 wherein the bimetal arm is a composite bimetal, comprising at least two bimetallic arms.

6. The creepless, snap action thermostat of claim 5 wherein the composite bimetal arm also acts as a heater for the thermostat.

7. The creepless, snap action thermostat of claim 1 wherein a first electrical contact and a second electrical contact are provided for connection of the thermostat into a circuit, said first electrical contact being mechanically and electrically connected to said first case half and said second electrical contact being electrically and mechanically connected to said second conductive half of the case.

* * * * *